US011017959B2

(12) United States Patent
Amponsah

(10) Patent No.: US 11,017,959 B2
(45) **Date of Patent: *May 25, 2021**

(54) NANOELECTROMECHANICAL DEVICES WITH METAL-TO-METAL CONTACTS

(71) Applicant: Kwame Amponsah, Ithaca, NY (US)

(72) Inventor: Kwame Amponsah, Ithaca, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/990,599

(22) Filed: Aug. 11, 2020

(65) Prior Publication Data

US 2020/0373095 A1 Nov. 26, 2020

Related U.S. Application Data

(63) Continuation of application No. 15/945,792, filed on Apr. 5, 2018, now Pat. No. 10,784,054.

(60) Provisional application No. 62/482,478, filed on Apr. 6, 2017.

(51) Int. Cl.

| | |
|---|---|
| ***H01H 57/00*** | (2006.01) |
| ***H01H 1/00*** | (2006.01) |
| ***H01H 11/04*** | (2006.01) |
| ***H01H 1/24*** | (2006.01) |

(52) U.S. Cl.

CPC ..... *H01H 1/0094* (2013.01); *H01H 1/24* (2013.01); *H01H 11/04* (2013.01); *H01H 2229/016* (2013.01)

(58) Field of Classification Search

CPC ..... H01L 21/00; H01H 1/24; H01H 1/0094

See application file for complete search history.

(56) References Cited

U.S. PATENT DOCUMENTS

| | | | |
|---|---|---|---|
| 4,992,660 | A | 2/1991 | Kobayashi |
| 5,426,302 | A | 6/1995 | Marchman et al. |
| 5,436,448 | A | 7/1995 | Hosaka et al. |

(Continued)

FOREIGN PATENT DOCUMENTS

| | | |
|---|---|---|
| EP | 1085327 | 3/2001 |
| JP | H07120482 | 5/1995 |

(Continued)

OTHER PUBLICATIONS

Yoomin, Ahn et al. "Si multiprobes integrated with lateral actuators for independent scanning probe applications" Journal of Micromechanics & Microengineering, Institute of Physics Publishing, Bristol, GB, vol. 15, No. 6, Jun. 1, 2005, pp. 1224-1229; doi: 10.1088/0960-1317/15//6/012.

(Continued)

*Primary Examiner* — Phuc T Dang

(74) *Attorney, Agent, or Firm* — Bond, Schoeneck & King, PLLC

(57) ABSTRACT

Nanoelectromechanical systems (NEMS) devices/switches and methods for implementing and fabricating the same with conducting contacts are provided. A nanoelectromechanical system (NEMS) switch can include a substrate; a source cantilever formed over the substrate and configured to move relative to the substrate; a drain electrode and at least one gate electrode formed over the substrate; wherein the source cantilever, drain and gate electrodes comprises a metal layer affixed to a support layer, at least a portion of the metal layer at the contact area extending past the support layer; and an interlayer sandwiched between the support layer and substrate.

10 Claims, 11 Drawing Sheets

(56) References Cited

U.S. PATENT DOCUMENTS

| | | | | |
|---|---|---|---|---|
| 5,666,190 | A | 9/1997 | Quate et al. | |
| 5,994,698 | A | 11/1999 | Kawade et al. | |
| 7,349,223 | B2 | 3/2008 | Haemer et al. | |
| 7,397,087 | B2 | 7/2008 | Chinthakindi et al. | |
| 7,872,482 | B2 | 1/2011 | Chong et al. | |
| 8,056,402 | B2 | 11/2011 | Hecker et al. | |
| 8,440,523 | B1 | 5/2013 | Guillorn et al. | |
| 8,575,954 | B2 | 11/2013 | Chong et al. | |
| 8,928,435 | B2 | 1/2015 | Despont et al. | |
| 10,048,289 | B2 | 8/2018 | Lal et al. | |
| 2002/0153583 | A1 | 10/2002 | Frazier et al. | |
| 2003/0020500 | A1 | 1/2003 | Altmann et al. | |
| 2004/0004182 | A1 | 1/2004 | Kranz et al. | |
| 2006/0230475 | A1* | 10/2006 | Moon | B82Y 15/00 438/142 |
| 2006/0257286 | A1 | 11/2006 | Adams | |
| 2007/0234786 | A1 | 10/2007 | Moon | |
| 2008/0258059 | A1 | 10/2008 | Saito et al. | |
| 2009/0001488 | A1 | 1/2009 | Magana et al. | |
| 2009/0114000 | A1 | 5/2009 | Hecker et al. | |
| 2010/0071098 | A1 | 3/2010 | Mirkin et al. | |
| 2010/0115671 | A1 | 5/2010 | Pryadkin et al. | |
| 2010/0154085 | A1 | 6/2010 | Maruyama et al. | |
| 2010/0205698 | A1 | 8/2010 | Faucher et al. | |
| 2010/0229265 | A1 | 9/2010 | Jin et al. | |
| 2010/0257643 | A1 | 10/2010 | Reifenberger et al. | |
| 2010/0263098 | A1 | 10/2010 | Müller et al. | |
| 2011/0055982 | A1 | 3/2011 | Watanabe et al. | |
| 2011/0126329 | A1 | 5/2011 | Despont et al. | |
| 2012/0138437 | A1* | 6/2012 | Ng | H01H 1/0094 200/181 |
| 2013/0249584 | A1 | 9/2013 | Lou et al. | |
| 2018/0294108 | A1* | 10/2018 | Amponsah | H01H 11/04 |

FOREIGN PATENT DOCUMENTS

| | | |
|---|---|---|
| JP | 2005507175 | 3/2005 |
| JP | 2005300177 | 10/2005 |
| WO | 03019238 | 3/2003 |
| WO | 2011159351 | 12/2011 |

OTHER PUBLICATIONS

Ming-Dou Ker, et al., "Fully Process-Compatible Layout Design on Bond Pad to Improve Wire Bond Reliability in CMOS ICs", IEEE Transaction on Components and Packaging Technologies, IEEE Service Center, Piscataway, NJ, US, Vo. 25, No. 2, Jun. 1, 2002 (Jun. 1, 2002), pp. 309-316, XP011070771, ISSN: 1521-3331; figures 1-7.

Koester, S. J. et al. "Wafer-level 3D integration technology", IBM Journal of Research and Development, International Business Machines Corporation, New York, NY, US, vol. 52, No. 6, Nov. 1, 2008 (Nov. 1, 2008), XP002676160, ISSN: 0018-8646, DOI: 10.1147/JRD.2008.5388565, pp. 583-597.

Song, Z.G. et al., "Front-end processing defect localization by contact-level passive voltage contrast technique and root cause analysis", Physical and Failure Analysis of Integrated Circuits, 2002, IPFA 2002, proceedings of the 9th International Symposium on the Jul. 8-12, 2002, Piscataway, NJ, USA, IEEE, Jul. 8, 2002 (Jul. 8, 2002), XP010597768, ISBM: 978-0-7803-7416-4, pp. 97-100.

International Search Report and the Written Opinion of the International Searching Authority, International Application No. PCT/US2018/026171, pp. 1-14, dated Aug. 22, 2018.

* cited by examiner

NANOELECTROMECHANICAL DEVICES WITH METAL-TO-METAL CONTACTS

CROSS-REFERENCE TO RELATED APPLICATION

This application is a Continuation Application of U.S. patent application Ser. No. 15/945,792, filed Apr. 5, 2018, which application claims priority to U.S. Provisional Patent Application Ser. No. 62/482,478, filed Apr. 6, 2017, entitled "Nanoelectromechanical Devices with Metal-to-Metal Contacts," the entire disclosures of which are incorporated herein by reference in their entireties.

FIELD OF THE INVENTION

The present disclosure is directed generally to nanoelectromechanical systems (NEMS) devices with metal-to-metal contacts.

BACKGROUND

Nanotechnology provides techniques or processes for fabricating structures, devices, and systems with features at a molecular or atomic scale, e.g., structures in a range of one to hundreds of nanometers in some applications. For example, nano-scale devices can be configured to sizes similar to some large molecules, e.g., biomolecules such as enzymes. Nano-sized materials used to create a nanostructure, nanodevice, or a nanosystem that can exhibit various unique properties including optical properties, that are not present in the same materials at larger dimensions and such unique properties can be exploited for a wide range of applications.

SUMMARY OF THE INVENTION

Techniques, systems, and devices are described related to nanoelectromechanical systems (NEMS) devices and for implementing and fabricating nanoelectromechanical systems (NEMS) devices with conducting contacts.

The subject matter described in this disclosure can be implemented in specific ways that provide one or more of the following features. For example, the disclosed NEMS switches exhibit no or minimal leakage current in the OFF state, offer low insertion loss, include air gaps providing high isolation, and can be fabricated at a low cost.

According to an aspect is a nanoelectromechanical system (NEMS) switch. The switch includes: (i) a substrate; (ii) a source cantilever formed over the substrate and configured to move relative to the substrate; (iii) a drain electrode and at least one gate electrode formed over the substrate, wherein the source cantilever, the drain, and the at least one gate electrode comprises a metal layer affixed to a support layer, at least a portion of the metal layer at a contact area between the metal layer and support layer extending past the support layer; and (iv) an interlayer sandwiched between the support layer and the substrate.

According to an embodiment, each of the source cantilever, the drain, and the at least one gate electrode are separated by air gaps.

According to an embodiment, the metal comprises platinum, gold, tungsten, or nickel.

According to an embodiment, the support layer comprises silicon, silicon dioxide, or silicon nitride.

According to an embodiment, the source cantilever is configured to deflect laterally with respect to the substrate.

According to an embodiment, the interlayer is an insulator. According to an embodiment, the insulator comprises silicon, silicon dioxide, or silicon nitride.

According to an aspect is a method for manufacturing a NEMS switch comprising a metal overhang at the source cantilever, the drain, and the at least one gate electrode. The method includes etching a portion of the support layer at a contact area.

According to an embodiment, the step of etching the support layer comprises a gaseous phase dry isotropic etch. According to an embodiment, the step of etching the support layer comprises a liquid phase wet isotropic etch. According to an embodiment, the step of etching the support layer comprises a focused ion beam configured to remove a portion of the support layer at the contact area.

According to an aspect is a nanoelectromechanical system (NEMS) switch. The switch includes: (i) a substrate; (ii) a source cantilever formed over the substrate and configured to move relative to the substrate; (iii) a drain electrode and at least one gate electrode formed over the substrate, wherein the source cantilever, the drain, and the at least one gate electrode comprises a metal layer; and (iv) an interlayer sandwiched between the metal layer and the substrate.

According to an embodiment, the metal layer comprises molybdenum silicide, platinum, gold, tungsten, or nickel.

According to an embodiment, the interlayer is an insulator. According to an embodiment, the insulator comprises silicon, silicon dioxide, or silicon nitride.

According to an aspect is a method for operating a NEMS switch. The method includes: (i) applying voltage potentials to a first gate electrode; (ii) determining the first gate electrode's voltage that causes a source cantilever of the NEMS switch to contact a drain electrode of the NEMS switch; (iii) pre-biasing the NEMS switch by applying a voltage to the first gate whereby the pre-biased voltage is less than the gate voltage required to bring the source cantilever in contact with the drain electrode; (iv) applying a voltage on a second gate electrode to bring the source cantilever into contact with the drain electrode; and (v) transferring a signal between the source cantilever and the drain electrode.

According to an embodiment, the source cantilever, the drain electrode, and the first gate electrode comprise a metal layer affixed to a support layer, at least a portion of the metal layer at a contact area between the metal layer and support layer extending past the support layer.

According to an embodiment, the NEMS switch further comprises an interlayer sandwiched between the support layer and the substrate.

DETAILED DESCRIPTION OF EMBODIMENTS

Figure 1:
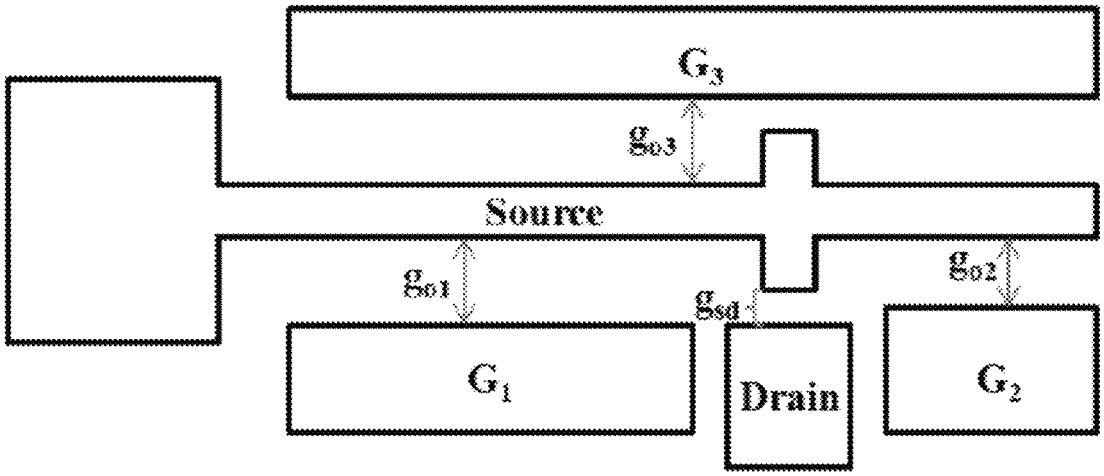
FIG. 1 shows a schematic of an exemplary NEMS switch of the disclosed technology showing the source, drain and gate terminals as well as the air gaps, in accordance with an embodiment.

Techniques, systems, and devices are described in detail herein and below related to nanoelectromechanical systems (NEMS) devices and for implementing and fabricating nanoelectromechanical systems (NEMS) devices with conductive contacts. In one aspect, a NEMS device can include a substrate, a source cantilever formed over the substrate and configured to move relative to the substrate, a drain formed over the substrate, and first, second and third gates formed over the substrate and separated from the source by first, second and third gaps, respectively. The source cantilever, the drain, the first, second and third gates form a NEMS actuator switch in which the source cantilever moves relative to the substrate in response to control voltages applied to the source cantilever, the drain, and the first, second and third gates. In some implementations of the device, for example, the device can be pre-biased at an electrical signal substantially close to a gate contact voltage. In some implementations of the device, for example, the substrate can include Si, Ge, SiC, pyrex and glass.

The source cantilever, the drain, and the first, second and third gates can include a metal or a metal affixed to a support structure. In some implementations of the device, for example, the third gate can be electrically floating, the drain can be set at an electrical potential, and the source cantilever can be configured to switch between different positions in response to varying control voltages applied to the first and second gates. In some implementations of the device, for example, the device can further include a junction gate field effect transistor (JFET) formed over the substrate to include a JFET drain, a JFET source, and a JFET gate, in which the JFET gate is coupled to the source cantilever to form a JEFT-NEMS actuator switch.

In one embodiment, for example, an exemplary NEMS-based actuator device can include a NEMS switch design in which the air gaps are configured to be larger such that there is no pull-in during the operation of the switch. For example, a metal can be used as the structural and conducting contact material for the NEMS switch in this exemplary design.

To reduce gate leakage current and polydepletion effects in future generations of advanced transistors such as the FinFET or Ultrathin-Body MOSFET, the International Roadmap for Semiconductors (ITRS) has suggested the use of high-k gate dielectrics and dual-metal-gate electrodes. The inventor has recognized that molybdenum silicide ($MoSi_x$) and pure Molybdenum (Mo) seem to be the ideal metal gate stack because of the appropriate workfunctions to n-channel and p-channel devices respectively. Hence, $MoSi_2$ is a material in commercial foundries.

At the same time, MEMS technology is currently leveraging various materials such as silicon, silicon dioxide and $MoSi_2$ layers that are present in CMOS technology. Besides $MoSi_2$ being a great midgap metal for the next generation of transistors, it has a high Young's modulus (430 GPa) which makes it ideal as a structural material for nanostructures such as accelerometers, switches and gyroscopes. $MoSi_2$ also exhibits a superb etch resistance to HF and Buffered Oxide Etch. Herein, described in an embodiment, is the use of $MoSi_2$ as a structural material for a NEMS switch. NEMS switches are favored for their near zero ideal power dissipation and abrupt ON-OFF state transitions. But some of the major challenges in NEMS switches are stiction of the source terminal to the drain, high switching voltages, stress gradient in the structural material used and maintaining a low contact resistance. Disclosed is an exemplary NEMS switch that is CMOS compatible and addresses some of these challenges.

The disclosed NEMS switch is designed to operate in non-pull-in fashion. Pull-in is an instability phenomenon where, for example, in a parallel plate capacitor with the bottom plate fixed and the top plate free to move displaces one-third of the actuation gap and the electrical force becomes larger than the mechanical restoring force. Under this condition, the top plate becomes unstable and snaps or pulls-in to the bottom plate.

The pull-in voltage is given by the following equation:

$$V_p = \sqrt{\frac{8}{27}\frac{Kd_o}{\varepsilon A}} \quad \text{Eq. (1)}$$

where $V_p$ represents the pull-in voltage, K is the spring constant of the cantilever, $d_o$ is the initial actuation gap, ε is the permittivity of the dielectric in the actuation gap, in this case its air and A is the actuation area. Equation 1 stipulates that to prevent pull-in the actuation gap has to be increased. FIG. 1 shows a schematic of an exemplary device which shows multiple electrodes as well as air gaps. In this example, the contact gap ($g_{sd}$) was designed to be (300 nm) such that the source is fully in contact with the drain before pull-in at either $g_{01}$ (900 nm) or $g_{02}$ (700 nm). The source cantilever is 25 μm long, 500 nm wide and has a thickness of 1 μm.

FIG. 1 shows a schematic of an exemplary NEMS switch of the disclosed technology showing the source, drain and gate terminals as well as the air gaps. The exemplary device operation is as follows:

(1.) The source and $G_2$ are grounded and $G_3$ is floating. The drain is set at a potential.

(2.) Sweep $G_1$ until the source contacts the drain. This is the gate contact voltage ($V_c$).

(3.) Pre-bias the device close to the gate contact voltage.

(4.) Apply switching voltage ($V_{sh}$) to $G_2$ to usher full contact.

Figure 2:
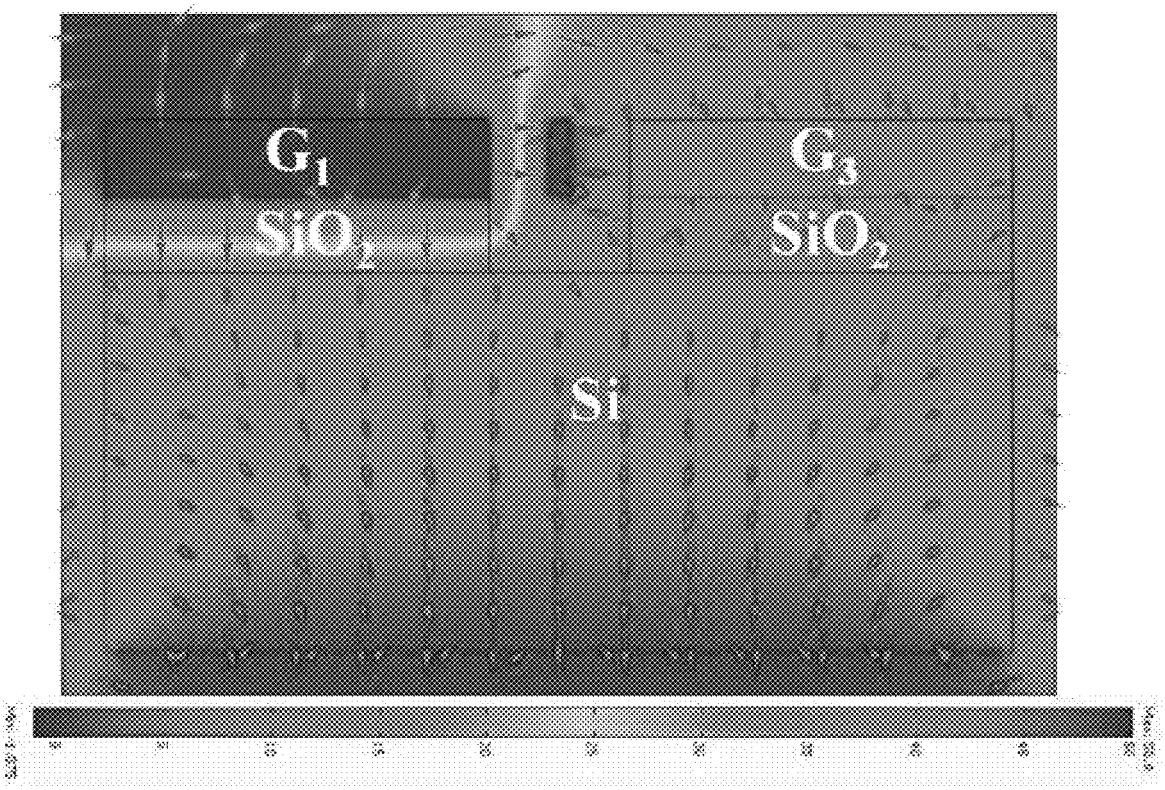
FIG. 2 shows a plot of an exemplary COMSOL™ electrostatics simulation of the feedthrough effect, in accordance with an embodiment.

The advantage of pre-biasing the device is that the switching voltage of the switch can be dramatically decreased to sub-1 V because the contact gap that needs to be closed is very small and as a result, small voltage on $G_2$ causes switching. Pre-bias is similar to the back-bias used in CMOS for adjusting the transistor threshold voltage. For example, sub-500 μV switching voltages demonstrated using the pre-bias scheme. Also, since the All-Metal structure is formed on an insulating layer (oxide layer), voltage transients applied to $G_1$ feedthrough the buried oxide layer and air to $G_3$ to generate a floating potential. FIG. 2 shows the electric field distribution when $G_1$ voltage is ramped to 50 V. With 50 V applied to $G_1$, $G_3$ acquires a floating potential of 11 V which serves as a restoring electrostatic force on the source cantilever when $G_1$ voltage is switched off. This automatic pull-back mechanism helps to mitigate the stiction problem which plagues NEMS switches.

FIG. 2 shows a plot of an exemplary COMSOL™ electrostatics simulation of the feedthrough effect that is generated when voltage ramps are applied to $G_1$. The electric field lines couple through air and the dielectric layer to terminate on $G_3$. The acquired floating potential on $G_3$ provides additional restoring force to the source cantilever.

The fabrication of the device is detailed in FIG. 3. An N-type silicon wafer is oxidized to grow 1.5 μm of dielectric ($SiO_2$). 1 μm of metal is sputter deposited on the wafer in the presence of Ar gas. Standard photolithography steps are used to pattern the switch electrodes. With the resist serving as an etch mask, the metal layer is either ion milled or etched with Reactive Ion Etching. The exemplary devices were released by Buffered Oxide Etch and finally dried with a critical point dryer or vapor Hydrofluoric acid to prevent stiction.

Referring to FIGS. 3A through 3F, in accordance with an embodiment, is a method for fabricating an all-metal NEMS switch.

Figure 3A:
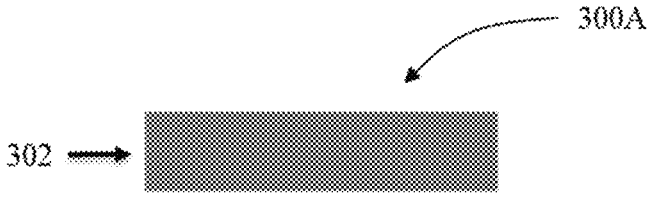
FIG. 3A is the first in a series of schematic diagrams illustrating the results of progressive process stages in fabricating an all-metal NEMS switch apparatus, in accordance with the embodiments, in accordance with an embodiment.
Figure 3B:
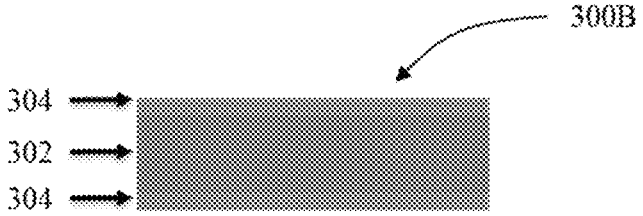
FIG. 3B is a schematic representation of a stage of fabrication of an all-metal NEMS switch apparatus, in accordance with an embodiment.
Figure 3C:
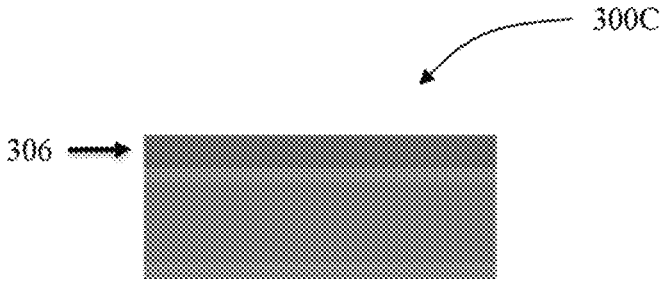
FIG. 3C is a schematic representation of a stage of fabrication of an all-metal NEMS switch apparatus, in accordance with an embodiment.
Figure 3D:
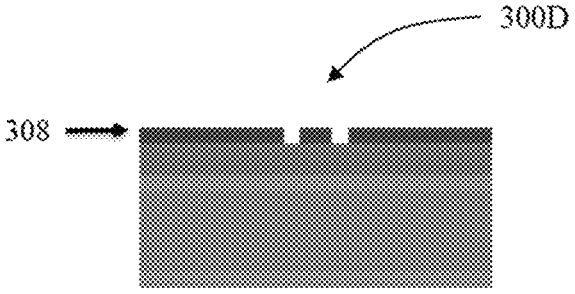
FIG. 3D is a schematic representation of a stage of fabrication of an all-metal NEMS switch apparatus, in accordance with an embodiment.
Figure 3E:
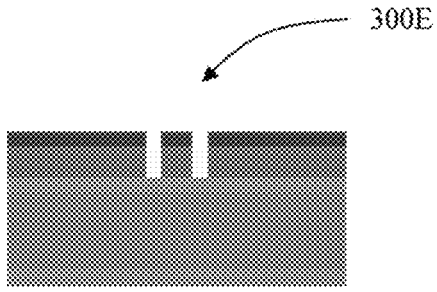
FIG. 3E is a schematic representation of a stage of fabrication of an all-metal NEMS switch apparatus, in accordance with an embodiment.

In FIG. 3A a substrate 302 is shown, and FIG. 3B shows an interlayer 304. In FIG. 3C, a metal layer 306 is deposited on the interlayer 304. In FIG. 3D, a photoresist 308 is spun on the metal layer 306 and standard lithography steps pattern the photoresist 308. In FIG. 3E, using the photoresist 308 as an etch mask, the metal layer 306 is etched with an ion mill, RIE or ICP process.

Figure 3F:
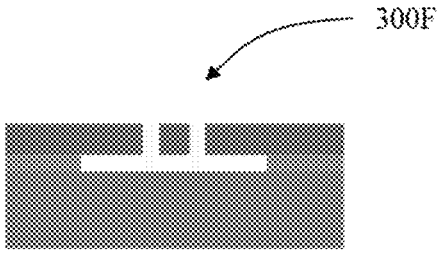
FIG. 3F is a schematic representation of a stage of fabrication of an all-metal NEMS switch apparatus, in accordance with an embodiment.

In FIG. 3F, either a wet or dry isotropic etch is used to etch the underlying interlayer 304 to freely suspend the source cantilever.

Figure 4:
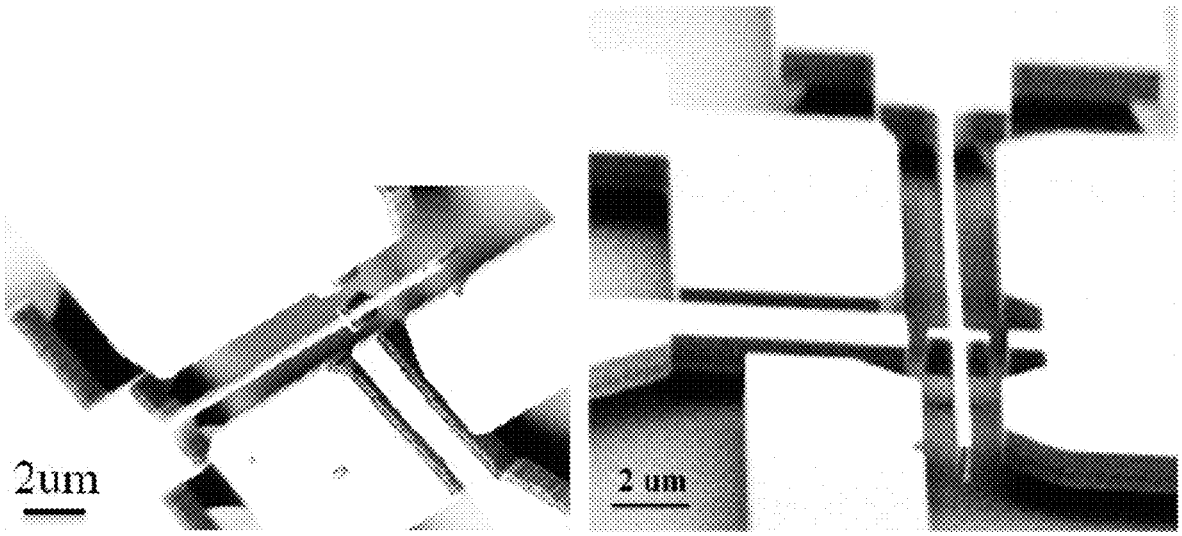
FIG. 4 shows a scanning electron microscopy (SEM) image of an exemplary fully released free standing $MoSi_2$ switch, in accordance with an embodiment.

FIG. 4 shows an SEM micrograph of the exemplary device. The exemplary device was first tested in ambient to investigate its switching behavior. It was optically observed that even though there was full contact of the source to the drain, no current would flow. For example, freshly sputtered $MoSi_2$ when exposed to air for 5 minutes forms $SiO_2$ and tiny amount of $MoO_2$ and after 24 hr exposure, the $SiO_2$ content increased and the $MoO_2$ was converted to $MoO_3$. An exemplary reaction that occurs at the $MoSi_2$ interface is given by Equation 2 and Equation 3:

$$\tfrac{1}{3}MoSi_2+O_2=\tfrac{2}{3}SiO_2+\tfrac{1}{3}MoO_2 \quad (2)$$

$$2MoO_2+O_2=2MoO_3 \quad (3)$$

The $MoSi_2$ surface is believed to be covered with a duplex oxide layer of $SiO_2$+$MoO_3$. This duplex layer can easily absorb carbonaceous contaminants as well as water vapor and hydrocarbons.

FIG. 4 shows a scanning electron microscopy (SEM) image of an exemplary fully released free standing $MoSi_2$ switch. As seen in the image, there is no stress gradient in the source cantilever. The drain and source contact areas were covered with this duplex oxide layer, water vapor and hydrocarbons.

Figure 5:
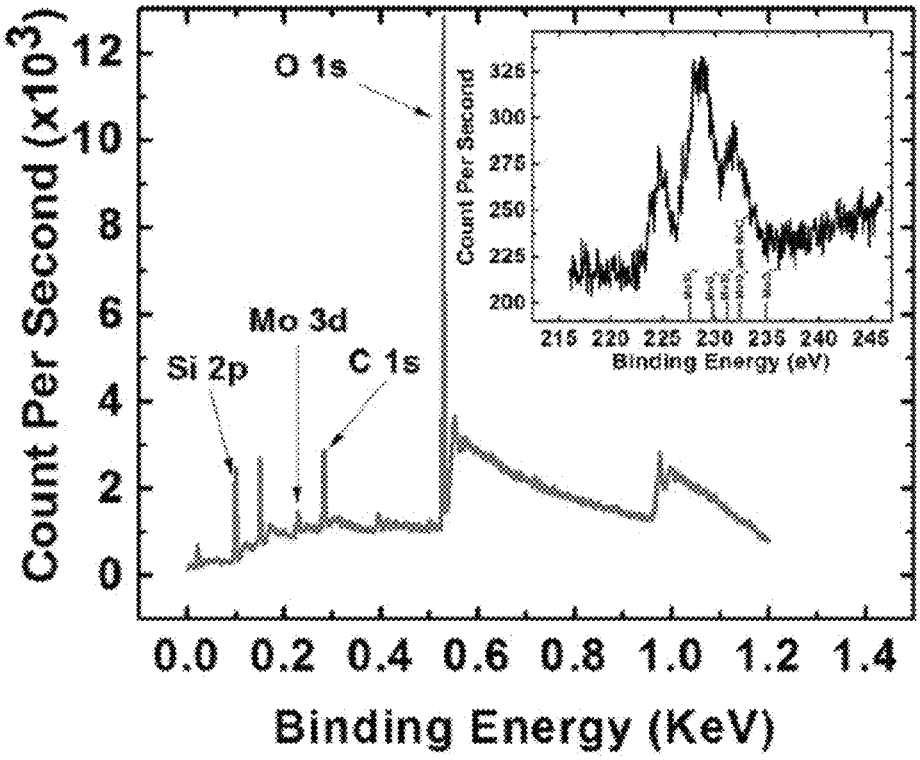
FIG. 5 shows a plot of an X-ray Photoelectron Spectroscopy (XPS) scan of an exemplary $MoSi_2$ surface showing peaks for silicon, Mo 3d, oxygen and the adventitious hydrocarbon, in accordance with an embodiment.

FIG. 5 shows an exemplary X-ray Photoelectron Spectroscopy (XPS) analysis of the $MoSi_2$ film which was conducted with Surface Science Instrument using a monochromated Aluminum K-alpha x-rays. A 300 μm beam spot size was used for scanning and a flood gun was used to neutralize charging effects. Oxygen was used as a reference in analyzing the data. As seen in FIG. 5, the spectra display the presence of the adventitious hydrocarbon (C is at 284.6 eV) as well as a high peak of oxygen (O 1s at 532 eV). The highest peak of Mo 3d occurs at 228 eV.

FIG. 5 shows a plot of an XPS scan of an exemplary $MoSi_2$ surface showing peaks for silicon, Mo 3d, oxygen and the adventitious hydrocarbon. The 2.95 eV shift in the O 1s peak was used to compensate for this measured results. The inset of FIG. 5 shows a high resolution scan which shows the presence of the Mo 3d5/2 and Mo 3d3/2 of the consolidated $MoSi_2$.

Figure 6:
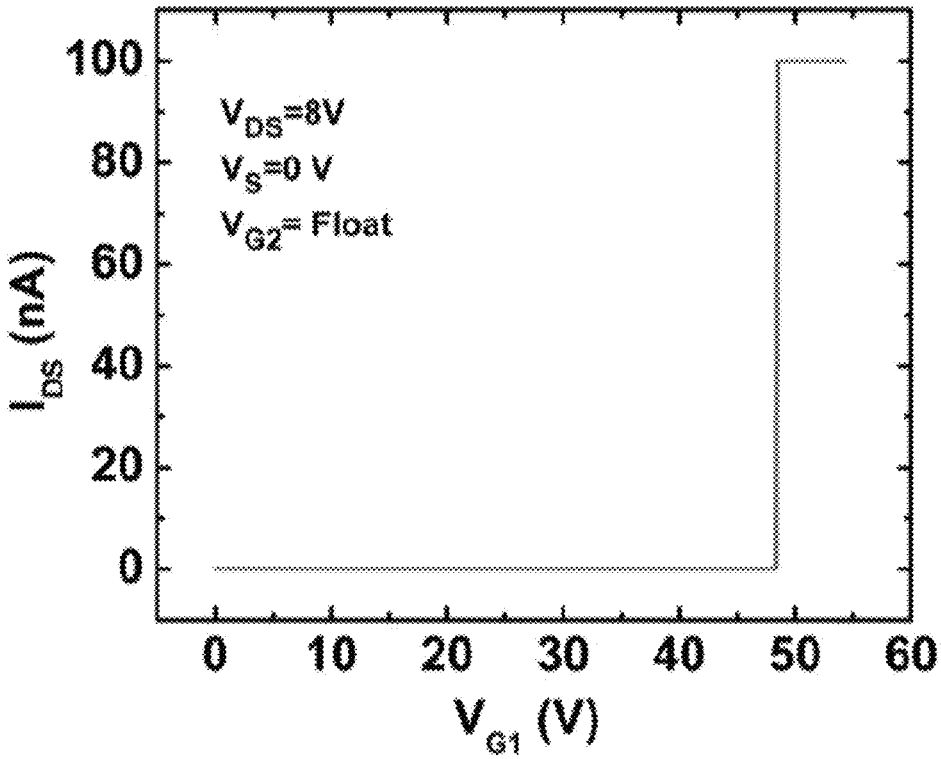
FIG. 6 shows an exemplary plot in which voltage ramps were applied to G1 until the source was in full contact with the drain, in accordance with an embodiment.

When the switch was tested in a vacuum probe station, at low pressures of 0.1 mbars, there was not significant current flow from the drain to the source until the pressure reached ~4e-4 mbars. At this pressure, the water vapor and the hydrocarbons desorbed from the contact area. To investigate the gate contact voltage, the source was grounded and 8 V applied to the drain. $G_2$ and $G_3$ were made to float and a 100 nA current compliance set for the drain and source currents. Voltage ramps were applied to $G_1$ until the source contacted the drain. Both the source and drain currents were monitored. FIG. 6 is the measured gate contact voltage of 48.2 V with an OFF state drain current of 83 pA and $I_{ON}/I_{OFF}$ ratio was 1204.

FIG. 6 shows plots of exemplary voltage ramps that were applied to $G_1$ until the source was in full contact with the drain. For example, the OFF state drain current was 83 pA with an $I_{ON}/I_{OFF}$ ratio of 1204.

Figure 7:
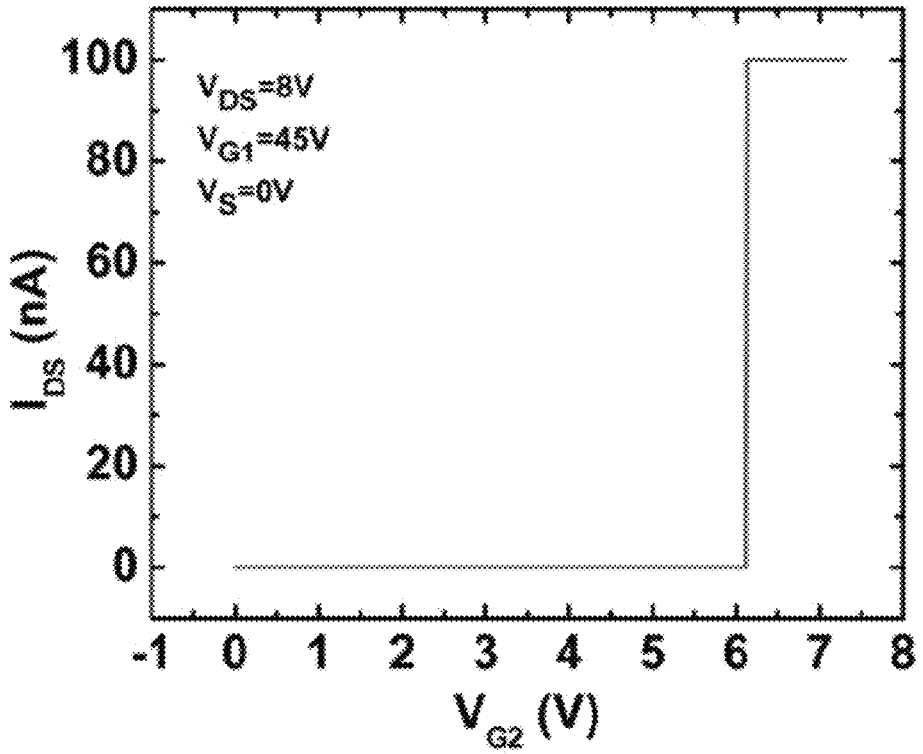
FIG. 7 shows an exemplary plot, with the device pre-biased at 45 V, in which voltage ramps were applied to G2 to fully bring the source in contact with the drain, in accordance with an embodiment.

With the gate contact voltage determined as 48.2V, the device was pre-biased to 45 V and voltage ramps applied to $G_2$ to usher in full contact. FIG. 7 is the measured switching voltage of 6.1 V. This switching voltage is scalable depending on the gate contact voltage. So as the pre-bias voltage is increased, less voltage is required by $G_2$ for switching.

FIG. 7 shows an exemplary plot, with the device pre-biased at 45 V, in which voltage ramps were applied to $G_2$ to fully bring the source in contact with the drain.

Figure 8:
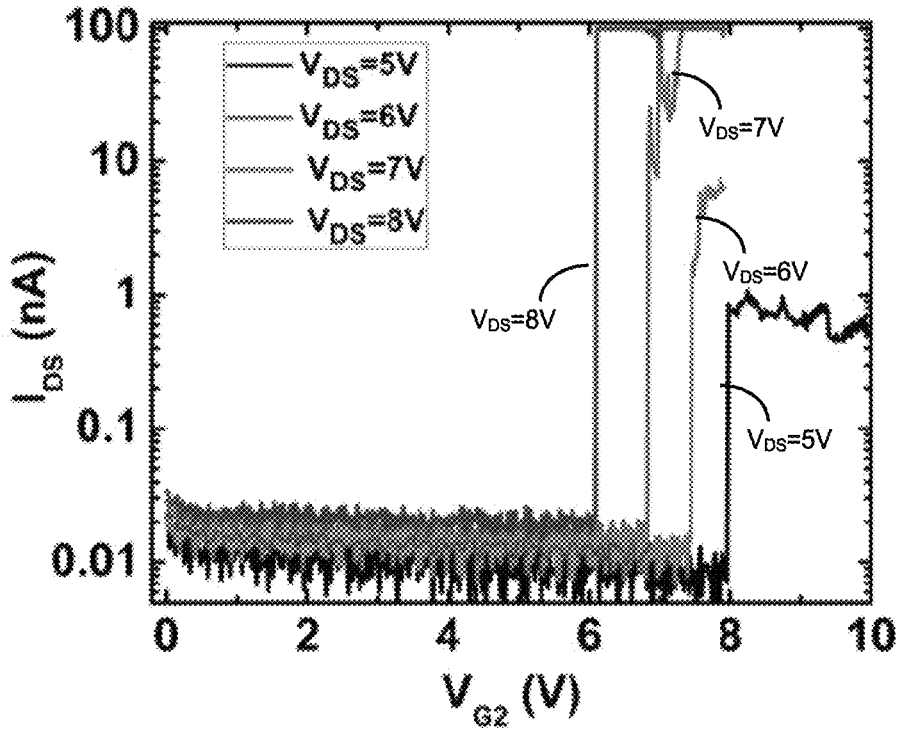
FIG. 8 shows an exemplary plot showing that increasing the drain voltage generates additional electric field that abruptly attracts the source to contact the drain terminal, in accordance with an embodiment.

The drain voltage has an effect on the switching voltage. As the source-drain gap decreases, any additional drain voltage will generate excess electric field that will abruptly attract the source to the drain. This phenomenon is similar to the conventional pull-in effect in NEMS devices but here, the source cantilever does not have to be displaced one-third of the air gap before it experiences instability and initiate a pull-in effect. FIG. 8 shows the effect of the drain voltage on the switching voltage of the device. From FIG. 8, the switching voltage can be tuned from 8 V to 6.1 V by increasing the drain voltage from 5 V to 8 V.

FIG. 8 shows an exemplary plot showing that increasing the drain voltage generates additional electric field that abruptly attracts the source to contact the drain terminal.

FIG. 8 also shows that IDS increases 100 folds from $V_{DS}$=5 V to $V_{DS}$=8 V. This drastic increment in drain current could be attributed to the fact that as $V_{DS}$ was increased, the electric field at the source and drain contact was also increased to a point where there was a partial breakdown of the $SiO_2$+$MoO_3$ duplex layer.

Figure 9:
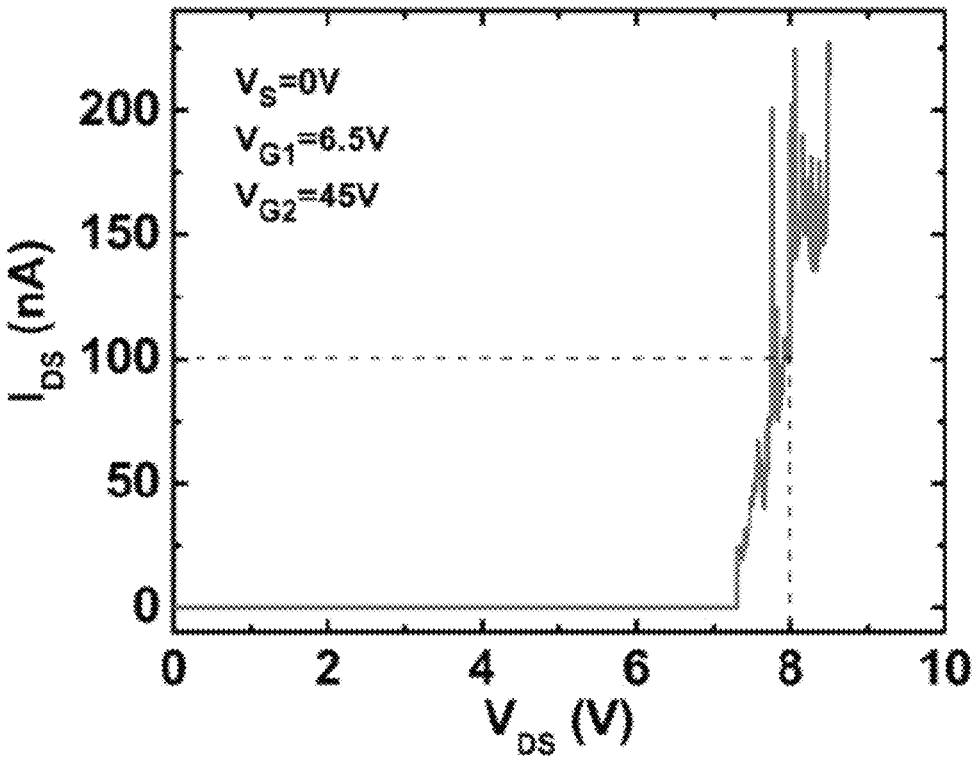
FIG. 9 shows an exemplary Current-Voltage plot of measurements of the exemplary source-drain terminals of the closed switch, in accordance with an embodiment.

To further investigate the possibility of the partial breakdown of the duplex layer, the switch was fully closed and the drain voltage ramped from 0 V to 8 V. FIG. 9 shows that substantial current conduction begins at $V_{DS}$=7.3 V where the duplex layer was partially broken down. The duplex layer is broken down and current begins to flow and the linear IV characteristics from 7.3 V to 8 V shows that an ohmic contact is established between the source and drain contacts. The source-drain current conduction path is very resistive (80 MΩ) which is due to the formation of the duplex layer and high contact resistance. Sputtering of oxide-resistant materials such as Platinum or Iridium around the $MoSi_2$ structures can also be implemented to decrease this resistance.

FIG. 9 shows an exemplary Current-Voltage plot of measurements of the exemplary source-drain terminals of the closed switch that shows that active current conduction begins at $V_{DS}$=7.3 V.

The reliability of the switch was examined in exemplary implementations by pre-biasing $G_1$ at 45 V and 8 V applied to the drain with the source grounded. A 50% duty cycle AC signal was applied to $G_2$ with a peak-to-peak voltage of 18 V, running at 10 KHz. The drain current was sampled every 2 seconds and the implementation terminated when the value of the drain current reduced 8 times. For example, 302,240 cycles where accrued. For example, dielectric charging of the duplex layer may have caused the source to be stuck to the drain in this exemplary implementation. The exemplary device utilized in this exemplary implementation was inspected using SEM, but showed that the source was separated from the drain. For example, it is possible that during the transfer of the switch to the SEM, the dielectric layer was fully discharged.

Figure 10:
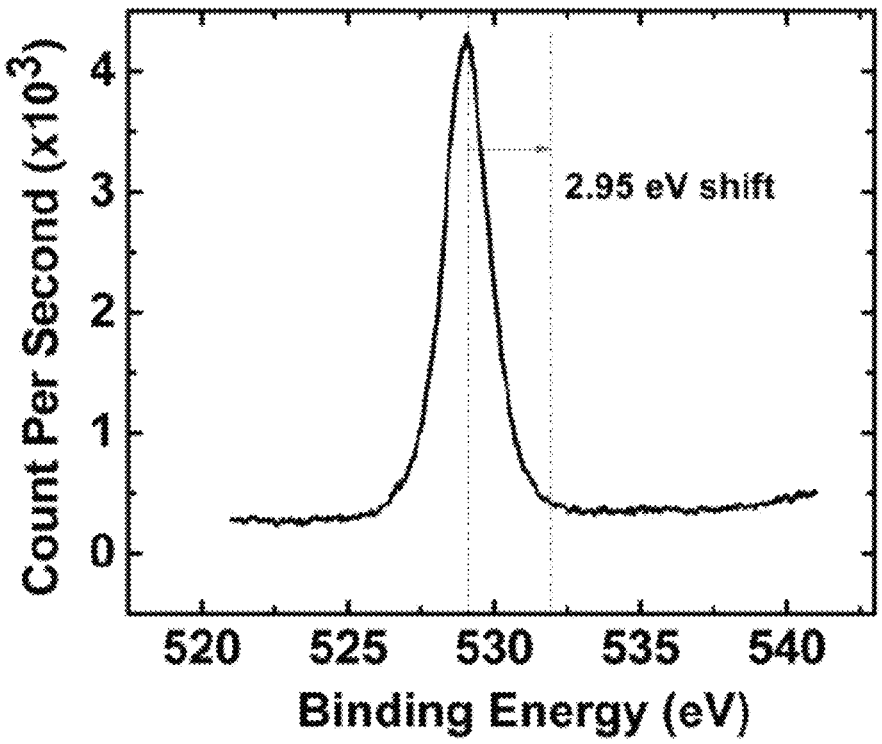
FIG. 10 shows an exemplary plot of a high resolution XPS scan, in accordance with an embodiment.

FIG. 10 shows an exemplary plot of a high resolution XPS scan showing a 2.95 eV shift in the O 1s peak which was caused by the use of the flood gun to neutralize the charging of the sample. Various techniques could be used to improve the source-drain contact resistance by depositing a conductive material (2D material, metal or alloy) at the contact or forming the entire switch from non-oxidizing metal.

Figure 11:
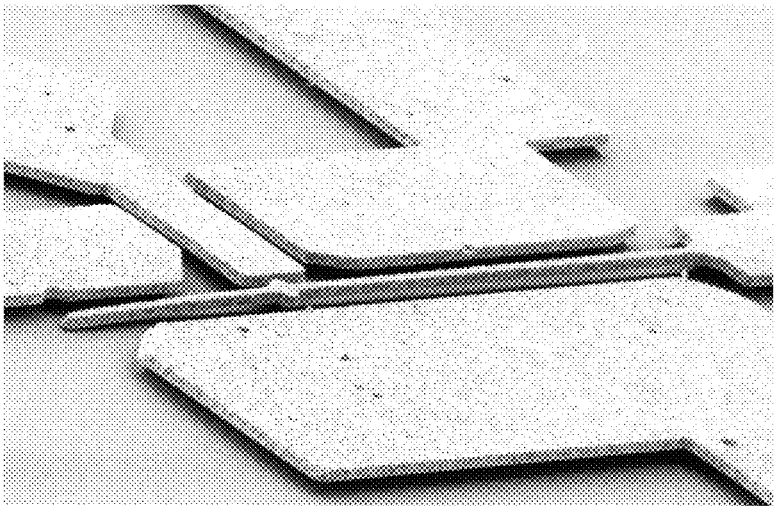
FIG. 11 shows a scanning electron microscopy (SEM) image of an exemplary fully released free standing gold switch, in accordance with an embodiment.

In one embodiment, the entire switch was fabricated from metal (i.e., gold) as shown in FIG. 11. As shown, the source cantilever exhibited an extensive amount of stress gradient.

Figure 12:
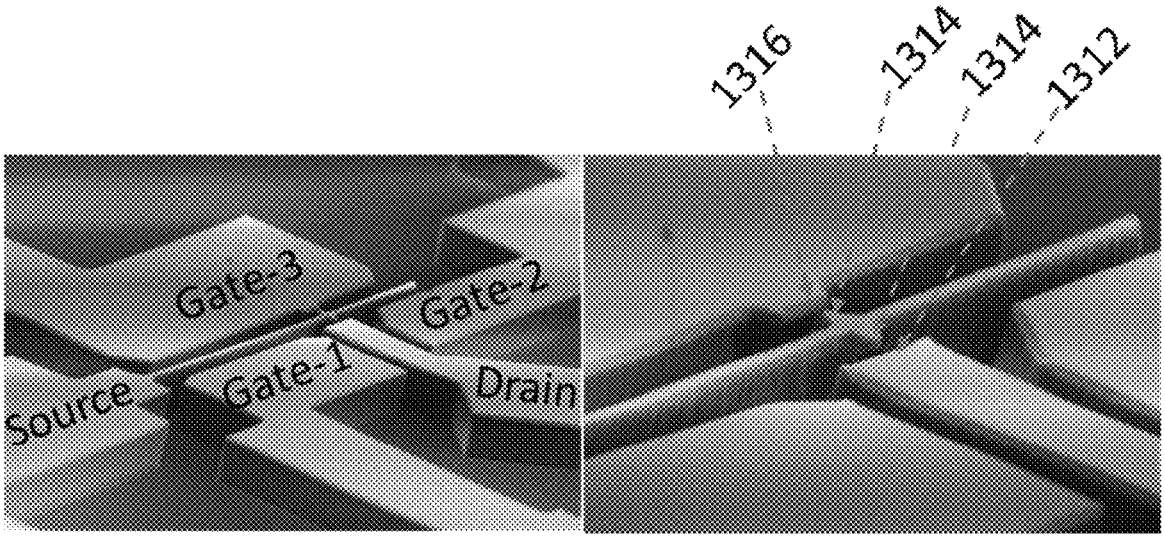
FIG. 12 shows a scanning electron microscopy (SEM) image of an exemplary fully released free standing platinum-platinum contact switch, in accordance with an embodiment.

In another embodiment, to control the amount of stress gradient in the source cantilever, the metal layer was affixed to a structural support layer as shown in FIG. 12. The support layer could be silicon, silicon dioxide, silicon nitride, another metal or alloy.

In addition, to ensure that a metal-to-metal contact is achieved between the source cantilever and the drain electrode, the portion of the support layer at the contact area could be removed either by dipping the device in a solution that etches the support layer or by using an isotropic dry etch to perform the undercut. FIG. 12 illustrates a NEMS switch with a platinum metal layer affixed to a silicon structural support layer. An isotropic dry RIE etch was used to remove a portion of the silicon support layer at the contact area.

Referring to FIGS. 13A through 13H, in accordance with an embodiment, is a method for fabricating a NEMS switch with overhang metal contacts is shown.

Figure 13A:
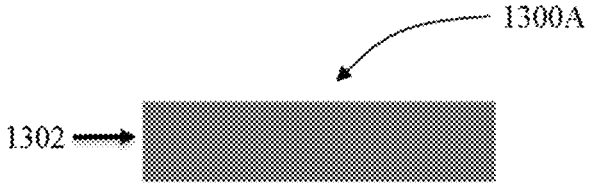
FIG. 13A is the first in a series of schematic diagrams illustrating the results of progressive process stages in fabricating a NEMS switch apparatus, in accordance with the embodiments.
Figure 13B:
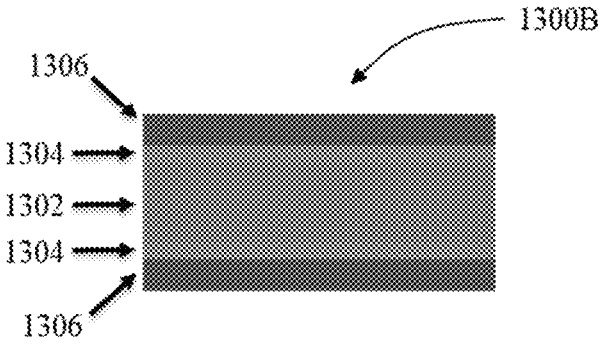
FIG. 13B is a schematic representation of a stage of fabrication of a NEMS switch apparatus, in accordance with an embodiment.
Figure 13C:
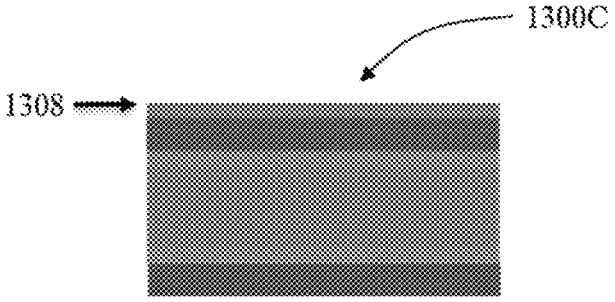
FIG. 13C is a schematic representation of a stage of fabrication of a NEMS switch apparatus, in accordance with an embodiment.
Figure 13D:
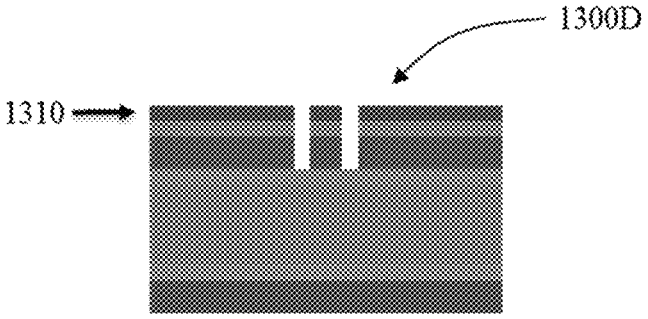
FIG. 13D is a schematic representation of a stage of fabrication of a NEMS switch apparatus, in accordance with an embodiment.

In FIG. 13A a substrate 1302 is shown, and FIG. 13B shows an interlayer 1304 and a support layer 1306. In FIG. 13C, a metal layer 1308 is deposited on the support layer 1306. In FIG. 13D, a photoresist 1310 is spun on the metal layer 1308 and standard lithography steps pattern the photoresist 1310 and etch the metal layer 1308 and the support layer 1306.

Figure 13E:
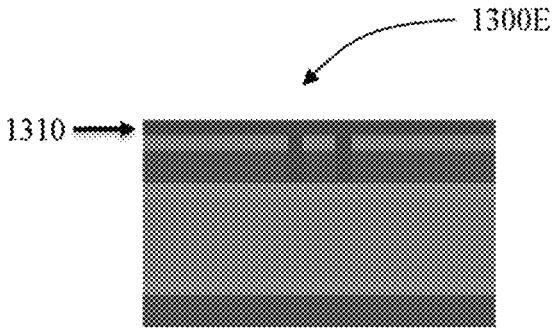
FIG. 13E is a schematic representation of a stage of fabrication of a NEMS switch apparatus, in accordance with an embodiment.
Figure 13F:
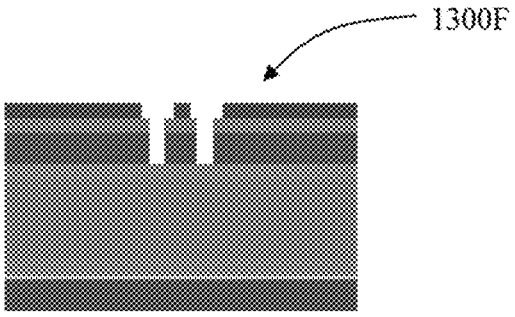
FIG. 13F is a schematic representation of a stage of fabrication of a NEMS switch apparatus, in accordance with an embodiment.
Figure 13G:
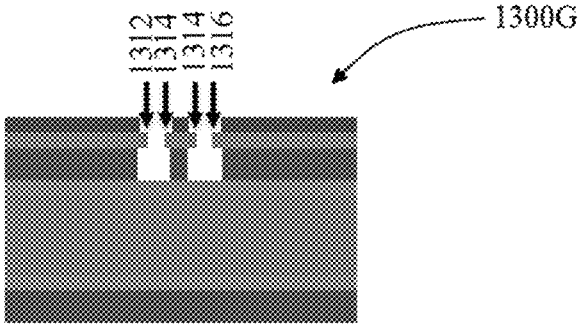
FIG. 13G is a schematic representation of a stage of fabrication of a NEMS switch apparatus, in accordance with an embodiment.

In FIG. 13E, a photoresist layer 1310 is spun. In FIG. 13F, standard lithography steps pattern the photoresist 1310 at the contact areas of the source, drain and gate electrode. In FIG. 13G, a dry isotropic etch is used to etch the support layer 1306 to produce a metal overhang at the contact area of the source 1314, drain 1312 and gate 1316.

Figure 13H:
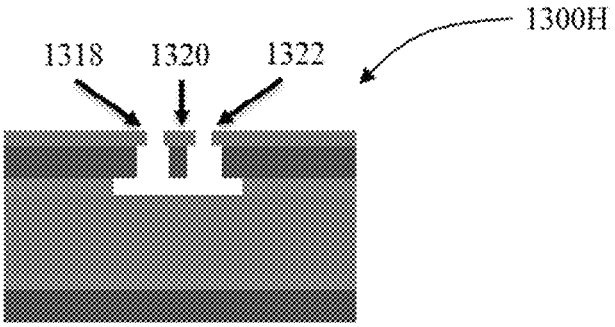
FIG. 13H is a schematic representation of a stage of fabrication of a NEMS switch apparatus, in accordance with an embodiment.

In FIG. 13H, either a wet or dry isotropic etch is used to etch the underlying interlayer 1304 to freely suspend the source cantilever.

Figure 14A:
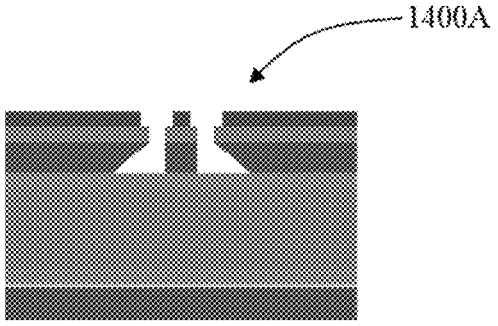
FIG. 14A is a schematic representation of a stage of fabrication of a NEMS switch apparatus, in accordance with an embodiment.
Figure 14B:
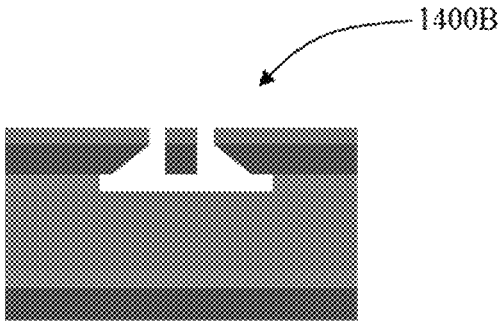
FIG. 14B is a schematic representation of a stage of fabrication of a NEMS switch apparatus, in accordance with an embodiment.

In another embodiment, using the same process flow as illustrated in FIG. 13A-13F, instead of using an isotropic dry etch to create the metal overhang, a Focused Ion Beam could be used to achieve the undercut as shown in FIGS. 14A and 14B.

The process described in FIGS. 13A-13H and 14A and 14B are not limited to the fabrication of NEMS switches but could be adapted to any N/MEMS device with at least two contacting points.

While various embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

The above-described embodiments of the described subject matter can be implemented in any of numerous ways. For example, some embodiments may be implemented using hardware, software or a combination thereof. When any aspect of an embodiment is implemented at least in part in software, the software code can be executed on any suitable processor or collection of processors, whether provided in a single device or computer or distributed among multiple devices/computers.

Only a few implementations and examples are described and other implementations, enhancements and variations can be made based on what is described and illustrated in this patent document.

What is claimed is:

1. A nanoelectromechanical system (NEMS) switch comprising:

a substrate;

a source cantilever formed over the substrate and configured to move relative to the substrate;

a drain electrode and at least one gate electrode formed over the substrate, wherein the source cantilever, the drain, and the at least one gate electrode comprises a metal layer; and an interlayer sandwiched between a support layer and the substrate, wherein the drain electrode is connected to the substrate via the interlayer.

2. The NEMS switch of claim 1, wherein said metal layer comprises molybdenum silicide, platinum, gold, tungsten, or nickel.

3. The NEMS switch of claim 1, wherein said interlayer is an insulator.

4. The NEMS switch of claim 3, wherein said insulator comprises silicon, silicon dioxide, or silicon nitride.

5. The NEMS switch of claim 1, wherein the gate electrode is connected to the substrate via the interlayer.

6. A nanoelectromechanical system (NEMS) switch comprising:

a substrate;

a source cantilever formed over the substrate and configured to move relative to the substrate;

a drain electrode and at least one gate electrode formed over the substrate, wherein the source cantilever, the drain, and the at least one gate electrode comprises a metal layer; and an interlayer sandwiched between a support layer and the substrate, wherein the source cantilever is connected to the substrate via the interlayer.

7. The NEMS switch of claim 6, wherein said metal layer comprises molybdenum silicide, platinum, gold, tungsten, or nickel.

8. The NEMS switch of claim 6, wherein said interlayer is an insulator.

9. The NEMS switch of claim 8, wherein said insulator comprises silicon, silicon dioxide, or silicon nitride.

10. The NEMS switch of claim 6, wherein the gate electrode is connected to the substrate via the interlayer.

* * * * *